US005848831A

United States Patent [19]

Tatsumi

[11] Patent Number: 5,848,831

[45] Date of Patent: Dec. 15, 1998

[54] ILLUMINATED UMBRELLA

[76] Inventor: Akira Tatsumi, 3-2-10, Omachi- Nishi, Sakai, Osaka, Japan

[21] Appl. No.: 810,180

[22] Filed: Mar. 1, 1997

[30] Foreign Application Priority Data

Nov. 11, 1996 [JP] Japan ..... 8-012100 U

[51] Int. Cl.[6] ..... A45B 3/02

[52] U.S. Cl. ..... 362/102; 362/109; 362/554; 135/16

[58] Field of Search ..... 362/102, 109, 362/32, 551, 554, 556; 135/16; 385/115

[56] References Cited

U.S. PATENT DOCUMENTS

| | | | |
|---|---|---|---|
| 1,595,023 | 8/1926 | Probe | 362/102 |
| 1,707,473 | 4/1929 | Goldberg | 362/102 |
| 2,246,836 | 6/1941 | Campbell | 362/102 |
| 3,275,815 | 9/1966 | Petroff et al. | 362/102 |
| 3,281,586 | 10/1966 | Gonzalez | 362/102 |
| 4,513,692 | 4/1985 | Kuhnsman et al. | 362/102 |
| 4,860,179 | 8/1989 | Mui et al. | 362/102 |
| 5,126,922 | 6/1992 | Andreasen | 362/102 |
| 5,463,535 | 10/1995 | Vest | 362/102 |
| 5,463,536 | 10/1995 | Chou et al. | 362/102 |

FOREIGN PATENT DOCUMENTS

| | | | |
|---|---|---|---|
| 1209952 | 10/1970 | United Kingdom | 362/102 |
| WO 90/06069 | 6/1990 | WIPO | 362/102 |

*Primary Examiner*—Alan Cariaso
*Attorney, Agent, or Firm*—Moonray Kojima

[57] ABSTRACT

The present invention relates to an illuminated umbrella intended to assure safety of the user of the umbrella in rainy weather, comprising a light source in a handle or a shaft, thereby illuminating at least part of the shaft coupled to the handle, and therefore the inside of the umbrella, and the face of the user or the vicinity are illuminated by illuminating the shaft itself which is near the face when using to notice the presence of man emphatically to others and drivers, so that the safety of the user in traffic may be enhanced.

1 Claim, 8 Drawing Sheets

ILLUMINATED UMBRELLA

BACKGROUND OF THE INVENTION

1. Field of the Invention

The present invention relates to an illuminated umbrella intended to assure safety of the user of the umbrella in rainy weather.

2. Description of the Prior Art

In conventional umbrellas having luminous means, fluorescent paint was applied on the tips, ferrule or other parts, or LEDs (light-emitting diodes) were built in the handle, ferrule, etc. These conventional umbrellas were designed to notify the drivers of vehicles and bikes of the presence of the user of the umbrella (in particular, pedestrian) to assure safety of the user by illuminating part thereof in spots.

In the conventional spot illumination, however, it was hard to distinguish from other luminous objects existing outdoors, such as fireflies, distant street lamps, and eyes of dogs and other animals, and it was insufficient for telling the presence of the user of the umbrella, and it was hard for the driver to recognize the presence of the user of the umbrella until the user of the umbrella is illuminated by the headlights of the vehicle or bike, and this problem was particularly evident at night.

SUMMARY OF THE INVENTION

It is hence a primary object of the invention to present an illuminated umbrella comprising a light source in a handle or a shaft, thereby illuminating at least part of the shaft coupled to the handle, and therefore the inside of the opened umbrella, and the face of the user or the vicinity are illuminated by illuminating the shaft itself which is near the face when using to notice the presence of man emphatically, so that the safety of the user while using the umbrella may be enhanced.

It is other object of the invention to present an illuminated umbrella in which at least part of the shaft is formed of a light permeable member, and therefore the light permeable member may be illuminated.

It is a different object of the invention to present an illuminated umbrella in which a light permeable member is disposed in at least part of a metal shaft, and therefore the light permeable member may be illuminated while maintaining a sufficient rigidity of the shaft.

It is a different object of the invention to present an illuminated umbrella in which an illuminating portion is disposed in a handle so as to illuminate the handle, therefore the handle can be illuminated simultaneously with illumination of the shaft.

It is a different object of the invention to present an illuminated umbrella in which changing means for changing the light emitting direction from the illuminating portion is disposed near the illuminating portion provided in the handle, and therefore the foot area of the user of the umbrella can be illuminated, so that the safety of the user can be protected from muddy pool, steps on road surface, or other obstacle.

It is a different object of the invention to present an illuminated umbrella in which the illuminating portion in the handle is set at the leading end of the handle and the changing means is composed of a flexible member, and therefore the emitting direction can be freely changed in a simple structure, and moreover the changing range can be expanded and the handling is improved.

It is a different object of the invention to present an illuminated umbrella in which an illuminating portion for illuminating the corresponding area is provided in at least one of the ferrule at the leading end of the shaft, or the tip at the leading end of the rib extended radially from the position near the leading end of the shaft, and therefore the upper end portion of the umbrella in use or the maximum outer dimension portion can be illuminated, so that both the recognition by others or drivers and the appearance can be enhanced.

It is a different object of the invention to present an illuminated umbrella in which illuminating portions are disposed in the shaft, ferrule, tips, and handle, and therefore both the recognition by drivers and the appearance can be enhanced.

It is a different object of the invention to present an illuminated umbrella in which illuminating portions are disposed at least in two positions of the shaft, ferrule, tips and handle, and a control unit for selectively illuminating the illuminating portions is provided, so that the illumination can be controlled by selecting the illuminating portion.

DETAILED DESCRIPTION OF THE PREFERRED EMBODIMENTS

Figure 1:
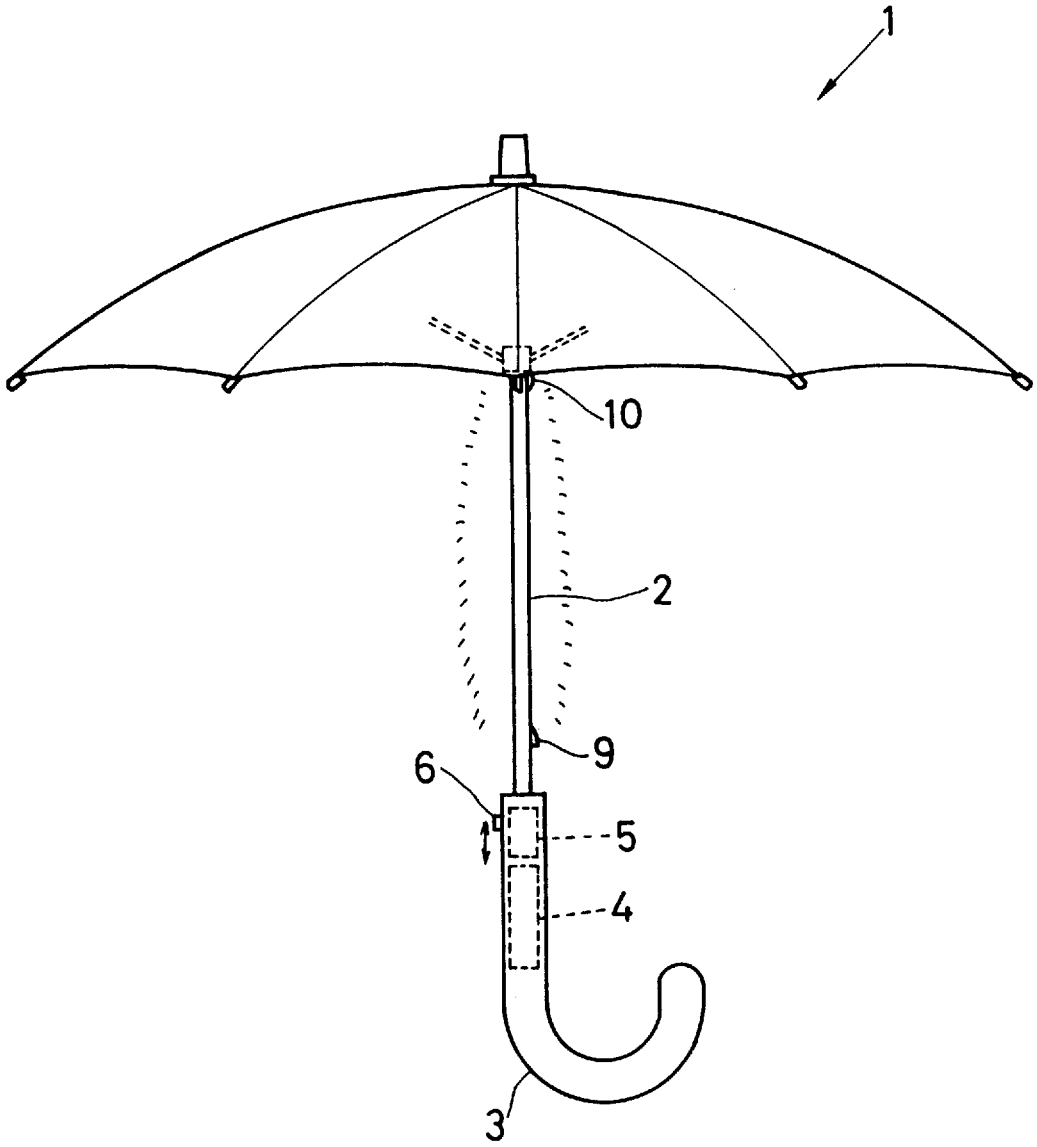
FIG. 1 is a side view showing an illuminated umbrella of the invention.

Referring now to the drawings, embodiments of the invention are described in detail below.

FIG. 1 is a side view of an opened state of an illuminated umbrella 1, and this umbrella 1 is designed to illuminate a shaft 2 coupled to a handle 3.

Figure 2:
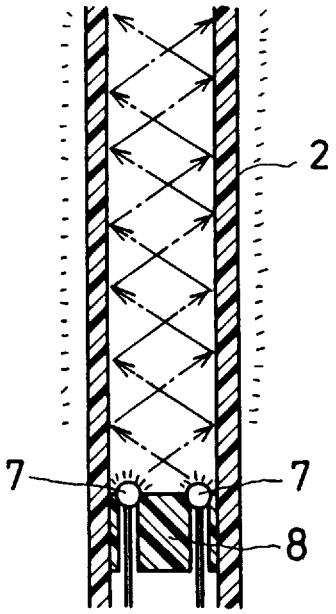
FIG. 2 is a sectional view of a shaft.

That is, the handle 3 for supporting the shaft 2 incorporates a battery 4 composed of rechargeable dry cell or the like and a control unit 5, and the control unit 5 comprises a switch 6 which can be manipulated from outside for on/off control of the electric power from the battery 4 and adjustment of illumination, and a visible ray LED 7 (illuminating portion) as the light source shown in FIG. 2.

An appropriate number of LEDs 7 are provided on a mounting seat 8 provided in the hollow shaft 2. The mounting position of the mounting seat 8 is preferred to be set at the upper side of a lower stopper 9 of the shaft 2, for the opening and closing structure of the illuminated umbrella 1.

The shaft 2 is formed of a hard synthetic resin so as to have a specified rigidity, and at least the illuminating area,. in this embodiment, the entire area between the lower stopper 9 and an upper stopper 10 is formed of light permeable colorless transparent member, colored transparent member, or milky white member. The light from the LED 7 illuminates the inside of the shaft 2 and is also emitted outward, and the inside of the opened illuminated umbrella 1 is illuminated.

Figure 3:
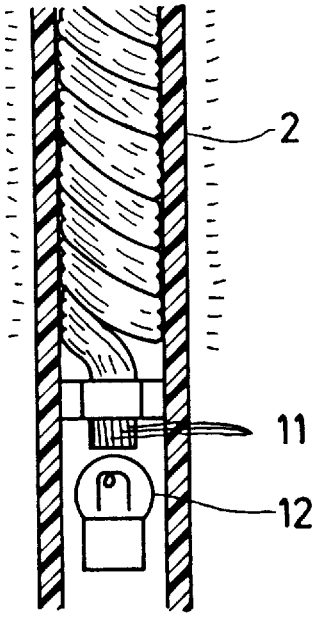
FIG. 3 is a sectional view of a shaft.

Instead of the visible ray LED 7, as shown in FIG. 3, an optical fiber 11 (illuminating portion) may be used to illuminate the shaft 2. In this case, a bulb 12 as light source is disposed at the upper of the lower stopper 9 in the shaft 2, and the end of the bundled optical fiber 11 is positioned above the bulb 12.

The optical fiber 1 is designed to emit light not only from its leading end but also from its middle, and may be extended straightly above, but it is preferred to store in a spiral bundle as shown in FIG. 3. In this case, internal loss of light in the shaft 2 is slight, and a sufficient illumination can be emitted.

When composed as shown in FIG. 1 and FIG. 2, or FIG. 1 and FIG. 3, at least part (or whole) of the shaft 2 itself at the close position to the face during use is illuminated (illuminated in a bar form in this embodiment), and the inside of the umbrella and the face of the user or the vicinity are illuminated, so that the presence of man is emphatically noticed to others or drivers, and the safety of the user during use of the umbrella can be assured, and in particular notable effects are obtained at night.

Figure 4:
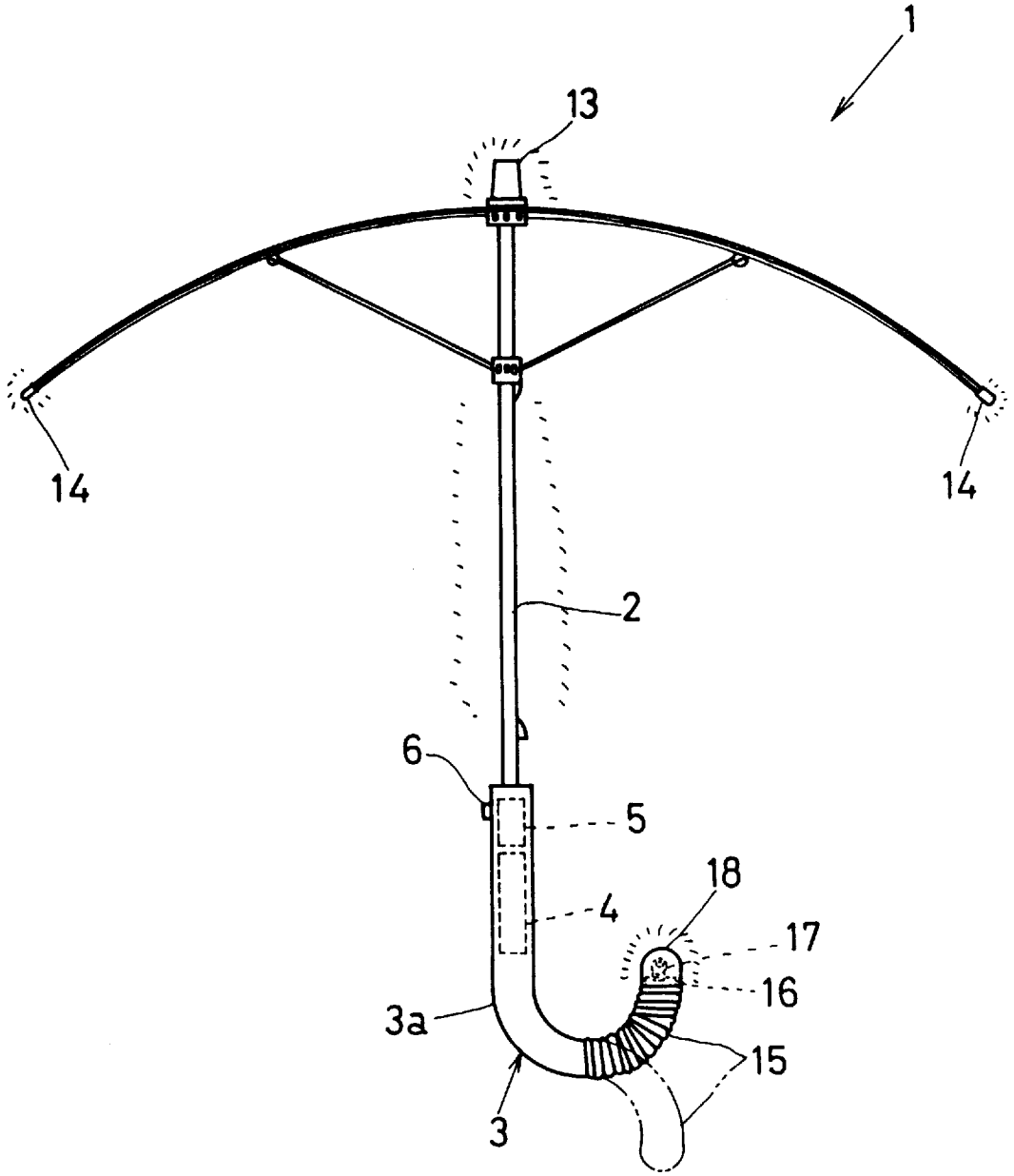
FIG. 4 is an explanatory diagram showing other embodiment of an illuminated umbrella of the invention.

FIG. 4 shows other embodiment of an illuminated umbrella, and this illuminated umbrella is designed to emit light not only from the shaft 2, but also from the handle 2, ferrule, and tips 14. The illuminating means of the shaft 2 is same as in the foregoing embodiment.

The handle 3 is formed in a J-form in its entire structure, having a multi-node structure from the lower end curved position, and a foldable hollow flexible pipe 15 (changing means) is provided, a socket 16 is fitted to the pipe 15, and a bulb 17 (illuminating portion) is detachably fitted as a light source to the socket 16. The bulb 17 is covered and protected by a detachable and light permeable cap member 18.

The live part of the socket 16 is electrically connected to the battery 4 and control unit 5 through the flexible pipe 15 and handle main body 3*a*.

Since the bulb 17 is fitted to the leading end of the flexible pipe 15, it is possible to emit light from the bulb 17 not only upward and downward, but also in slant direction, horizontal direction, or other arbitrary direction. Accordingly, when the illuminating direction is upward, the inside of the umbrella may be favorably illuminated, and the illuminating direction can be freely changed by the flexible pipe 15, and flexibly coping with the manner of holding the umbrella, for example, the foot area of the user can be also illuminated. That is, the safety of the user can be protected from muddy pool, steps on road surface, and other obstacles, and moreover since it is designed to change the direction of the bulb 17 by the flexible pipe 15, extension of the changing range of the illuminating direction and enhancement of handling are achieved in a simple structure.

Figure 5:
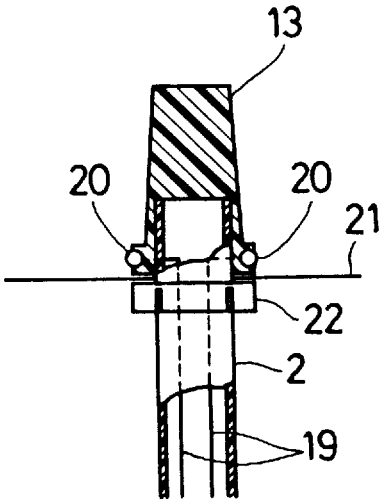
FIG. 5 is a sectional view of a ferrule portion.

In the ferrule 13 (see FIG. 5), a necessary number of visible ray LEDs 20 (illuminating portions) are provided at the leading end of a wiring 19 extended from the battery 4 and control unit 5 through the inside of the shaft 2, and these LEDs 20 are disposed properly on the circumference of the ferrule 13. Reference numeral 21 in the diagram shows the cloth of the umbrella.

Figure 6:
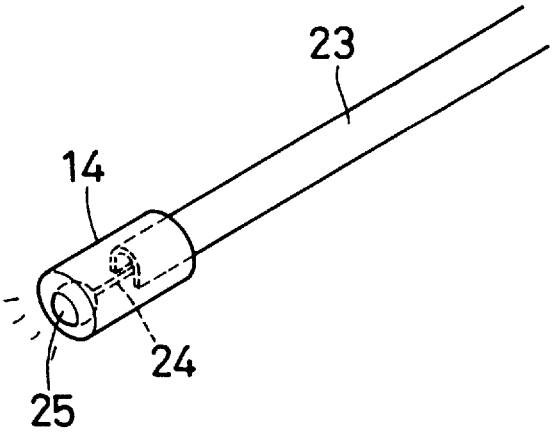
FIG. 6 is a perspective view of a tip portion.

In the tip 14 (see FIG. 6), a visible ray LED 25 (illuminating portion) as shown in FIG. 6 is attached to the leading end of a wire 24 laid in a rib 23 extended from the battery 4 and control unit 5 through the inside of the shaft 2, and spreading radially from an upper hub 22 attached to the leading end of the shaft 2.

Figure 7:
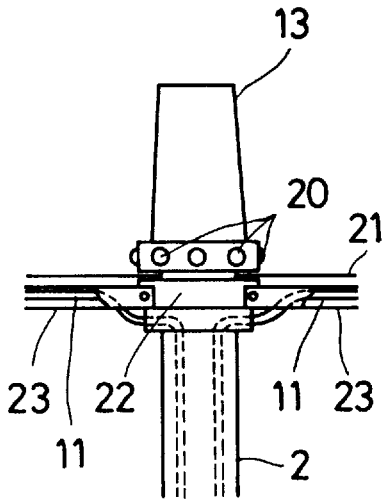
FIG. 7 is an explanatory view near the ferrule.
Figure 8:
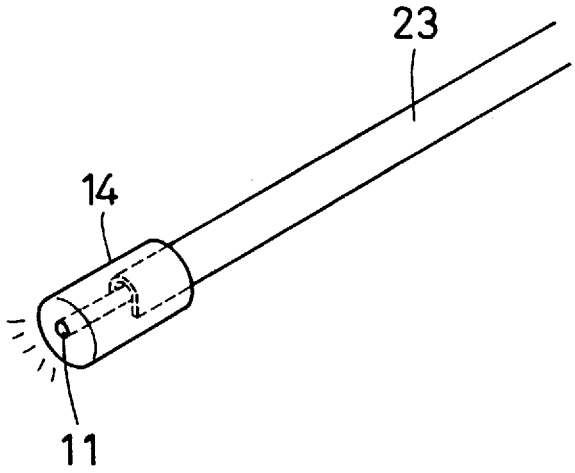
FIG. 8 is a perspective view of a tip portion.

Incidentally, when illuminating the shaft 2 by the optical fiber 11 as shown in FIG. 7, its leading end is led out into the rib 23 through the upper hub 22 from the shaft 2, and guided by the rib 23 as shown in FIG. 8, and the leading end of the optical fiber 11 is led out into the tip 14. In this case, when the optical fiber 11 is composed same as in the shaft 2 and the light is emitted also inside of the rib 23, the inside illuminating effect of the umbrella is further enhanced.

Moreover, when composed to control emission by selecting the illuminating portions, that is, the LED 7, optical fiber 11, bulb 17, LED 20, 25, by the control unit 5 and switch 6, it is possible to select depending on the conditions of use or taste, and, for example, where the traffic volume is small, the emission may be controlled to illuminate only the foot area aside from the shaft 2.

Thus, when constituted as shown in FIG. 4 to FIG. 8, since the illuminating portion (see LED 20, 25, optical fiber 11) for illuminating the corresponding area can be disposed at least in one of the ferrule 13 at the leading end of the shaft 2 and the tip 14 at the leading end of t he rib 23 extended radially from the position near the shaft 2, the upper end portion or the maximum outside diameter portion of the umbrella during use can be illuminated, so that both improvement of recognition by others or drivers and enhancement of appearance can be achieved.

Besides, the illuminating portions are provided in the shaft 2, ferrule 13, tips 14 and handle 3, and it is possible to present an illuminated umbrella capable of achieving both improvement of recognition by others or drivers and enhancement of appearance.

Still more, the illuminating portions are provided in at least two positions of the shaft 2, ferrule 13, tips 14, and handle 3, and the control unit 5 for selecting the illuminating portions is provided, so that the emission can be controlled by selecting the illuminating portions.

Figure 9:
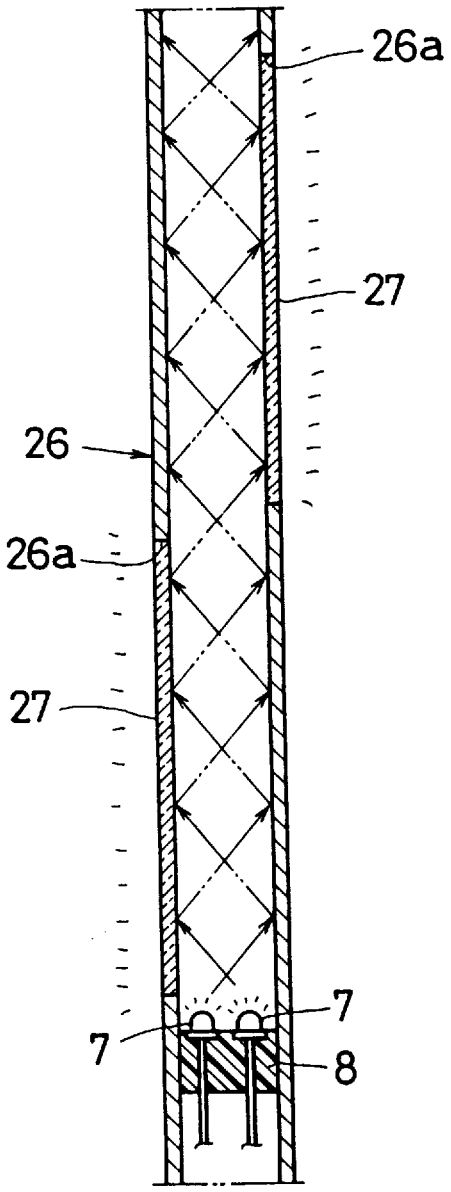
FIG. 9 is a sectional view showing other embodiment of shaft illumination.
Figure 10:
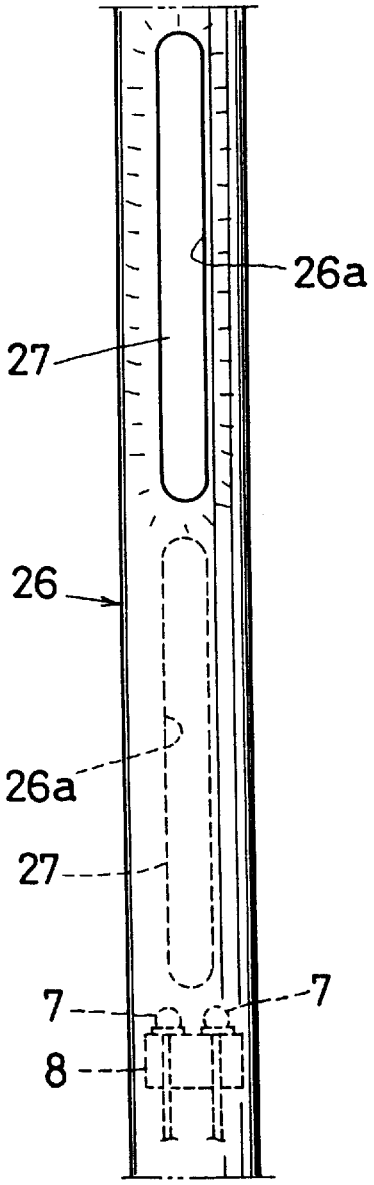

FIG. 9 and FIG. 10 show other embodiment for illuminating the shaft, and in this case, slits 26*a* are formed in plural directions in the longitudinal direction of a metal shaft 26, preferably in vertical offset plural positions, and light permeable members 27 are integrally disposed in the slits 26*a* so as not to interfere the opening and closing operation of the umbrella.

As the light permeable members 27, colorless transparent, colored transparent, or milky white hard synthetic resin, or reinforce glass is used, and adhering, fitting or other proper means may be employed for disposing them. Besides, same as in the embodiment in FIG. 2, a visible ray LED 7 is used as the light source.

By thus constituting, while maintaining a sufficient rigidity by the metal shaft 26, the light permeable members 27 may be illuminated in a slender form by the LED 7. In the embodiment shown in FIG. 9 and FIG. 10, too, the other points are nearly same in action and effect as in the foregoing embodiments, and same reference numerals as in other drawings are used in FIG. 9 and FIG. 10 to denote identical parts, and detailed description is omitted.

In the correspondence of the constitution of the invention and the foregoing embodiments:

The light source of the invention corresponds to the visible ray LED 7 and bulb 12 in the embodiments, and similarly thereafter, the light permeable member, to the shaft 2 itself (see FIG. 2 and FIG. 3), and the light permeable member 27, the illuminating portion, to the visible ray LED 7, 20, 25, optical fiber 11, and the bulb 17, and the changing means and flexible member, to the flexible pipe 15; but it must be noted that the invention is not limited to the illustrated embodiments alone.

For example, the entire shape of the handle 3 is not limited to the J-shape shown in the embodiments, but may be formed in I-shape, L-shape, or inverted T-shape. Besides, the control unit 5 may incorporate a flickering IC for changing over continuous lighting and flickering, and continuous lighting, flickering and extinguishing may be changed over by operation of the switch 6, and plural constitutions shown in the embodiments may be properly combined.

I claim:

1. In an umbrella comprising:

an elongate shaft having two ends;

a handle connected to one end of said shaft;

a spreadable canopy attached to the other end of said shaft;

a battery contained within one of said handle and shaft;

a switch contained on one of said handle and shaft;

lighting means connected to said battery and controlled to be ON and OFF by said switch; and light permeable means constructed as a part of one of said handle and shaft for emitting light from said lighting means;

the improvement comprising:

a spiral bundle of optical fibers contained within one of said handle and shaft and connecting said lighting means and said light permeable means so that light is transmitted through said spiral bundle of optical fibers and emitted through said light permeable means.

* * * * *